US006966445B1

(12) United States Patent
Johanna

(10) Patent No.: US 6,966,445 B1
(45) Date of Patent: Nov. 22, 2005

(54) SOAP SAVING HOLDER

(76) Inventor: Johanna, 201 Foliage Cir. Apt. D, Cary, NC (US) 27511

( * ) Notice: Subject to any disclaimer, the term of this patent is extended or adjusted under 35 U.S.C. 154(b) by 53 days.

(21) Appl. No.: 10/614,377

(22) Filed: Jul. 7, 2003

Related U.S. Application Data

(60) Provisional application No. 60/394,396, filed on Jul. 8, 2002.

(51) Int. Cl.[7] ..... A47F 7/00
(52) U.S. Cl. ..... 211/85.12
(58) Field of Search ..... 211/85.12; 248/309.4, 248/684, 686, 309.1, 176.1

(56) References Cited

U.S. PATENT DOCUMENTS 1,859,492 A * 5/1932 Balestra ..... 248/346.11
2,577,114 A * 12/1951 Eames ..... 248/684
3,019,548 A * 2/1962 Nadler ..... 248/686
3,104,490 A * 9/1963 Cornell ..... 248/684
3,343,774 A * 9/1967 Pryor ..... 248/346.11
4,391,427 A 7/1983 Foresman
4,775,124 A 10/1988 Hicks
5,020,753 A 6/1991 Green
5,029,802 A 7/1991 Ali
5,368,268 A 11/1994 Jodwischat
5,417,397 A 5/1995 Harnett
5,642,871 A 7/1997 Repert et al.
6,152,294 A 11/2000 Weinberg

* cited by examiner

*Primary Examiner*—Sarah Purol
(74) *Attorney, Agent, or Firm*—Mary-Jacq Holroyd; Johnston, Holroyd & Associates

(57) ABSTRACT

A soap holder has a flat base with a plurality of openings in the base and sides extending upwards from the base. The sides may have a plurality of teeth formed therein. The teeth may taper outward from the sides. A lip may extend from the base opposite the sides, and may have indentions therein. The soap holder may be made of stainless steel, aluminum, ceramic, glass, plastic or porcelain, and be of a single formed piece. The base of the soap holder may have a uniform geometric shape, such as a circular or triangular shape.

18 Claims, 3 Drawing Sheets

SOAP SAVING HOLDER

RELATED APPLICATIONS

This application claims the benefit of U.S. Provisional Application Ser. No. 60/394,396 filed on Jul. 8, 2002, the contents of which are incorporated herein by reference in its entirety.

FIELD OF THE INVENTION

The present invention relates to a holder for a bar of soap, and in particular, to a soap saving holder which provides drainage for a bar of soap thereby eliminating slime and preventing the bar of soap from dissolving.

BACKGROUND OF THE INVENTION

Bars of soap have the disadvantage of dissolving, and/or becoming slimy, after initial use when water collects under and around the bar of soap. Conventional soap dishes tend to pool the water around the bar of soap causing the soap to dissolve. Numerous soap saving holders have been developed in an attempt to prevent the soap from sitting in water, and to facilitate water removal. A variety of devices have been developed to inhibit dissolution of the bar of soap after use.

U.S. Pat. No. 5,029,802 invented by Ali on Jul. 9, 1991 discloses a soap saving device for a bar of soap wherein the outer surface of the device has a plurality of protuberances and the inner surface of the device is contoured to conform generally to the external surface of a bar of soap. Water and liquefied soap collect in a curve area of the device. The device of Ali is designed to conform to a rounded outer surface of a bar of soap, and is not useful for a flat or irregular surfaced bar of soap.

Magnetic soap saving devices have been developed whereby a bar of soap containing or attached to a piece of metal/magnet is attracted to a holder having a corresponding piece of magnet/metal thereon to attract and hold the soap in an elevated position preventing water from pooling under the bar of soap. U.S. Pat. No. 5,368,268, issued to Jodwischat on Nov. 29, 1994, describes a soap holding device which suspends a bar of soap in a bathroom or shower. The holding device has a fixture having a magnet attached thereto. A metal cap, which is attracted to the magnet, is provided and pushed into the bar of soap. When not in use the bar of soap can be suspended from the device keeping water from pooling under the soap.

U.S. Pat. No. 5,417,397, issued to Harnett on May 23, 1995, shows a similar magnetic soap holder that has a fixture with a magnet and a metal cap to push into a bar of soap. U.S. Pat. No. 5,642,871, issued to Repert et al. on Jul. 1, 1997, is similar to the patents of Harnett and Jodwischat except that the device can be hung from a hook instead of from a fixture that must be attached to a vertical surface as in the other magnetic soap holder devices.

U.S. Pat. No. 5,020,753, issued to Green on Jun. 4, 1991, teaches a soap holder which has a projection adapted to extend into a recess in a bar of soap, which projection holds the bar of soap in such a manner as to minimize contact with surfaces preventing the pooling of water. U.S. Pat. No. 4,775,124, issued to Hicks on Oct. 4, 1988, describes a suspension soap holder consisting of a bent wire that receives a bar of soap. The bent wire provides minimal contact with the bar of soap. Similarly, U.S. Pat. No. 4,391,427, issued to Foresman on Jul. 5, 1983, shows a holder for a bar of soap that utilizes an "X" shaped endless cord, supported by four mounts, forming a horizontal soap bar support that minimizes contact between the holder and the soap. U.S. Pat. No. 6,152,294, issued to Weinberg on Nov. 28, 2000, shows a travel soap dish having a metal basket which minimizes contact with the bar of soap. These devices may not be placed in conventional soap dishes but stand alone as separate soap holders.

None of the above inventions and patents, taken either singularly or in combination, is seen to describe the instant invention as claimed.

SUMMARY OF THE INVENTION

The present invention relates to a soap holder having a base with a plurality of openings in the base and sides extending upwards from and substantially perpendicular to the base (similar to a bottle cap). The sides may have a plurality of teeth formed therein, which teeth may taper outward from the sides of the soap holder. A bar of soap placed on top of the soap holder will maintain its form and not dissolve because water will drain away from the base through the openings. Slime will not build up under the bar of soap because of the mechanism of drainage. The bar of soap may be placed on the holder in a conventional soap dish.

An advantage of the soap holder of the present invention is that it may be used with any shape or size bar of soap. The present invention does not need to conform to the shape of the bar of soap but can be used with any bar of soap having a variety of shapes.

Another advantage of the present invention is that it does not require a fixture or hook be installed to utilize the device. The bar of soap is merely placed on top of the holder. No extra fixtures are required to utilize the soap holder.

Yet another advantage of the present invention is that it prevents water from pooling under the bar of soap. The present invention provides just enough drainage area to allow the bar of soap to dry without pooling water and dissolved soap under the device. The soap holder of the present invention avoids the formation of soap slime in the soap dish.

A further advantage of the present invention is that it may be used in combination with any conventional soap dish including on indentions provided on sinks for holding a bar of soap. By using the present invention in a conventional soap dish, the bar of soap is permitted to dry after use and is not sitting in a pool of water. Because the present invention prevents the bar of soap from sitting in a pool of water the bar of soap is preserved and will last a great dealer longer.

These and other objects of the present invention will become readily apparent upon further review of the following drawings and specification.

BRIEF DESCRIPTION OF THE DRAWINGS

The novel features of the described embodiments are specifically set forth in the appended claims; however, embodiments relating to the structure and process of making the present invention, may best be understood with reference to the following description and accompanying drawings.

Similar reference characters denote corresponding features consistently throughout the attached drawings.

DETAILED DESCRIPTION OF PREFERRED EMBODIMENTS

Figure 1:
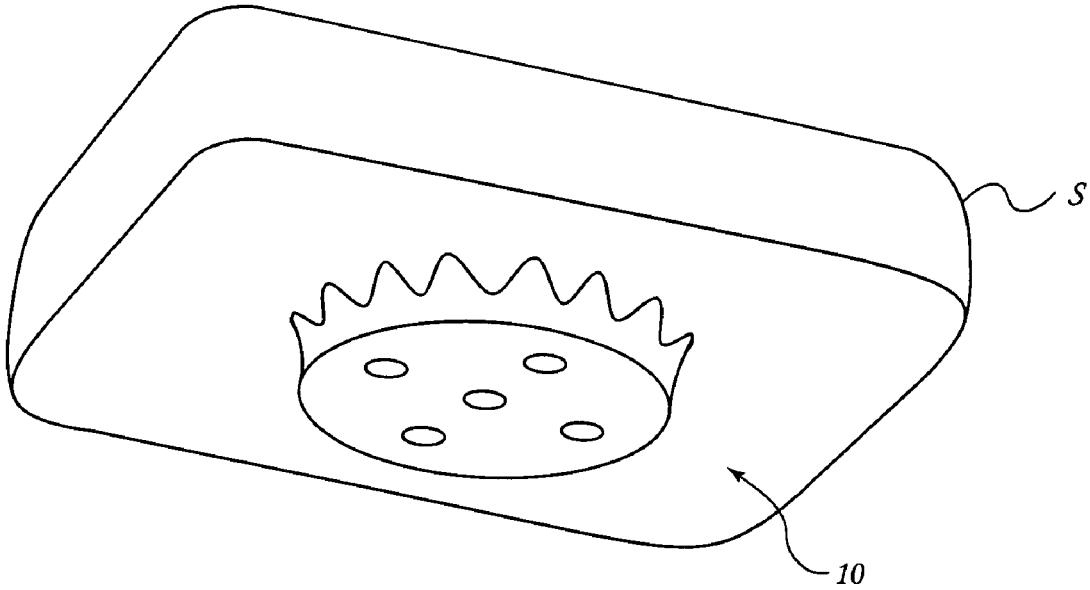
FIG. 1 is an environmental perspective view of the present invention with a bar of soap disposed thereon.
Figure 2:
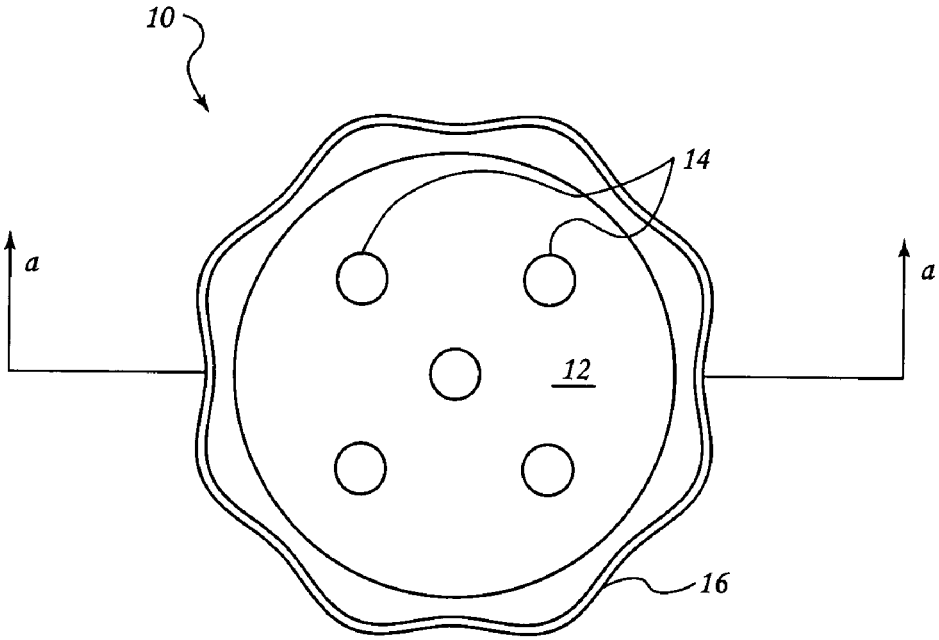
FIG. 2 is a top view of the holder according to the present invention from directly above the holder of FIG. 1.
Figure 3:
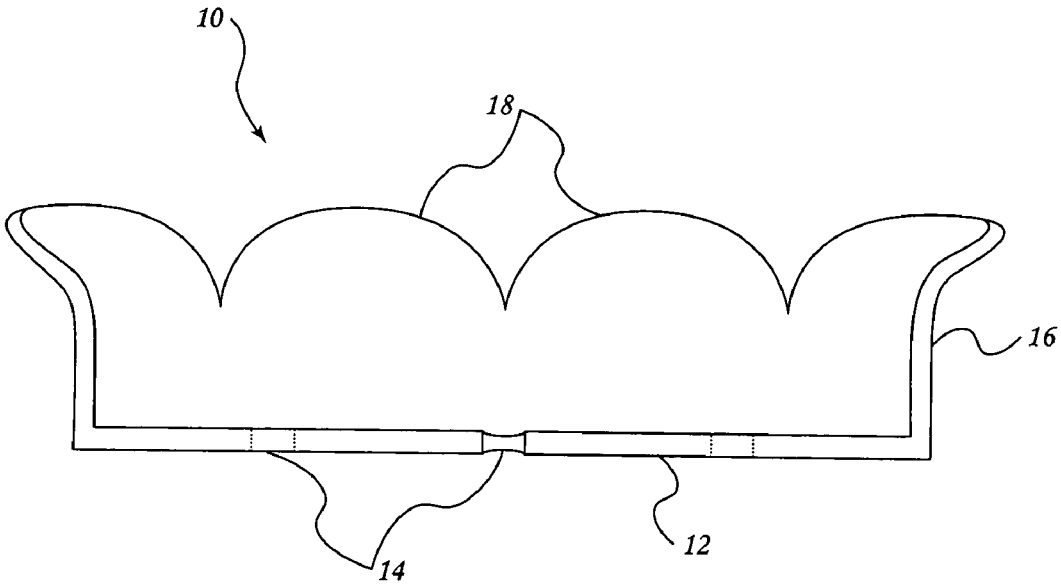
FIG. 3 is a cutaway side view of the holder of FIG. 2 taken along the line a—a indicated.
Figure 4:
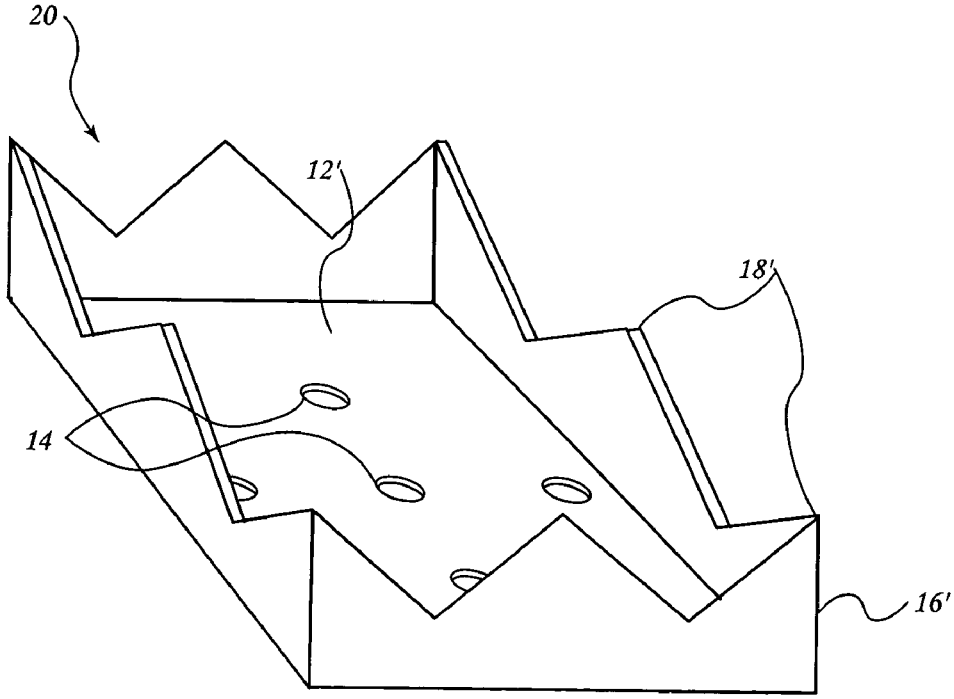
FIG. 4 is a perspective view of an alternate embodiment of the holder according to the present invention.
Figure 5:
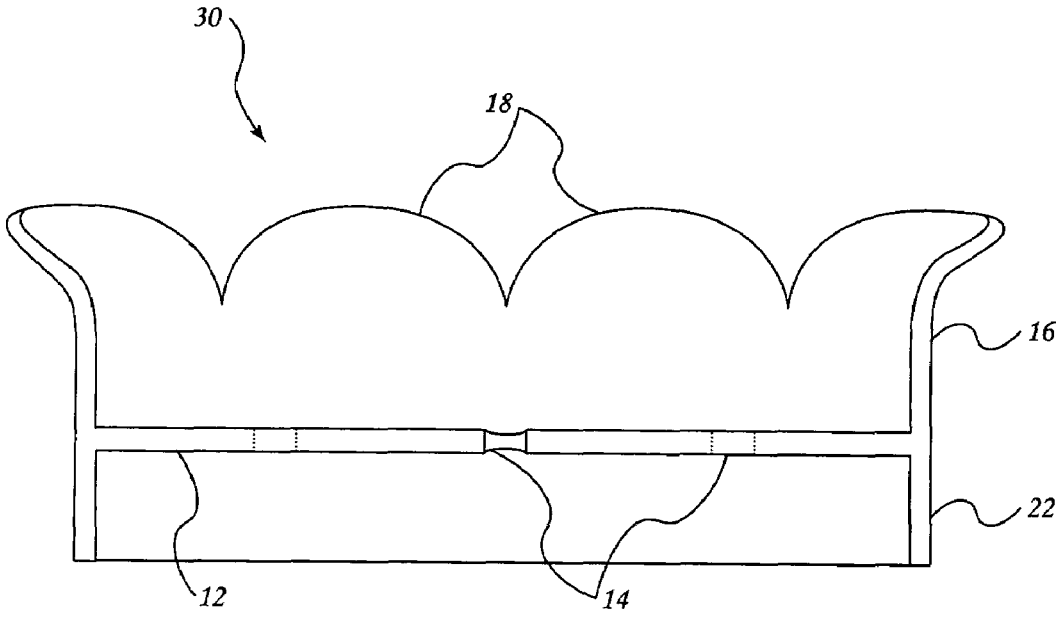
FIG. 5 is a cutaway side view of another alternate embodiment similar to FIG. 3.
Figure 6:
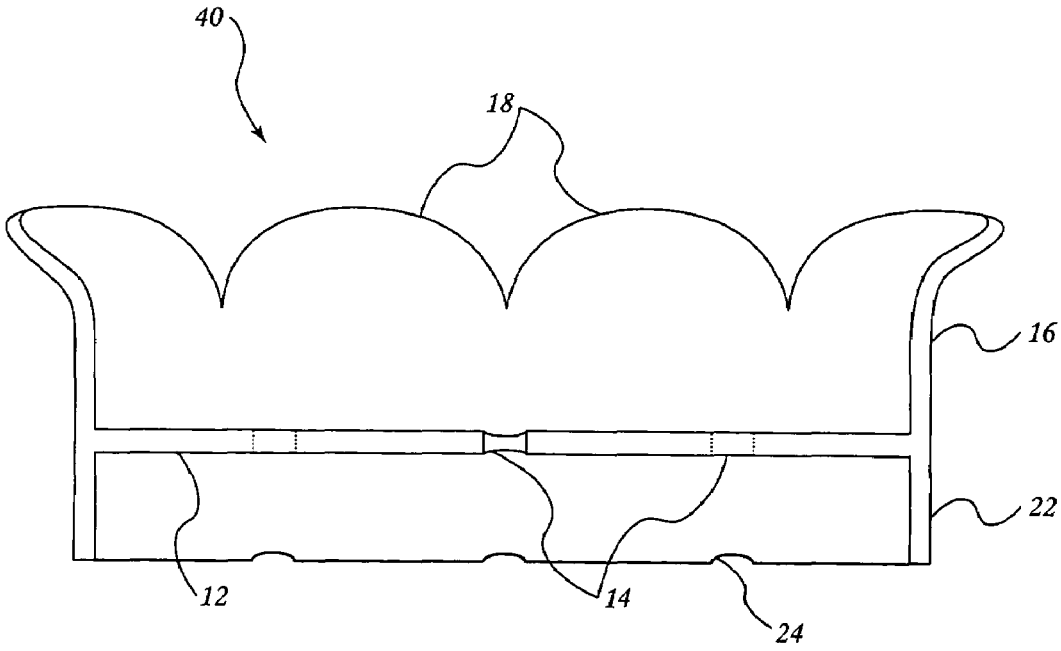
FIG. 6 is a cutaway side view of yet another alternate embodiment similar to FIGS. 3 and 5.

An embodiment of a soap holder 10 according to the present invention is shown in FIG. 1 having a bar of soap S disposed thereon. FIG. 2 shows a top view and FIG. 3 shows a cutaway side view of the soap holder 10 of FIG. 1. FIGS. 4, 5 and 6 show alternative embodiments of the present invention.

The soap holder 10 has a rigid flat base 12 having openings 14 therein for drainage, and rigid sides 16 extending upwards therefrom, and substantially perpendicular thereto, for retaining a bar of soap S thereon. The sides 16 are thin and rigid so as to be easily pressed into a bar of soap. Teeth 18 are preferably formed in the rigid sides 16. The teeth 18 may be rounded as shown most clearly in FIG. 3, pointed as shown in FIG. 4, or a combination thereof (not shown). Furthermore, the teeth 18 may taper outwards from the sides of the holder, as shown most clearly in FIG. 3. The tapered teeth 18 may extend initially perpendicular from the base and then taper outwards therefrom. The base 12 of the soap holder 10 may have any shape desired including a circular shape as shown in FIGS. 1, 2, 3, 5 and 6, an oval shape (not shown), a rectangular or square shape as shown in FIG. 4, or any other shape desired in a manner analogous the varied shapes of cookie cutters.

In a preferred embodiment, both the base 12 and sides 16 of the soap holder 10 are composed of stainless steel. Other compositions, such as aluminum, plastic, glass, ceramic, porcelain or the like, are possible. The only consideration is durability and resistance to degradation by exposure to water or soap. A preferred embodiment also has the base 12 and sides 16 formed of a single molded piece. The base 12 and sides 16 are preferably of a single formed piece.

Alternative embodiments of the soap holder according to the present invention are shown in FIGS. 4 through 6. The soap holder 20 shown in FIG. 4 has a square or rectangular base 12' and sides 16' with pointed teeth 18'. The soap holders 30 and 40 of FIGS. 5 and 6 have round bases as in FIGS. 1 through 3. Each of the bases 12 of soap holders 30 and 40, however, has a lip 22 extending opposite the sides 16. The lip 22 of soap holder 40 has indentions 24 therein that facilitate drainage of water therethrough.

It is to be understood that the present invention is not limited to the embodiments described above, but encompasses any and all embodiments within the scope of the following claims.

What is claimed is:

1. A soap holder comprising:

a. a cap structure having i. a flat rigid base having openings therein, and ii. sides extending substantially perpendicular from said base;

b. said sides being thin and rigid so as to be easily pressed into a bar of soap for retaining and supporting the soap thereon; and c. said base having a lip extending substantially perpendicular therefrom in the opposite direction from said sides.

2. The soap holder of claim 1, wherein:

a. said base has a uniform geometric shape.

3. The soap holder of claim 1, wherein:

a. said base has a circular shape, oval shape, square shape or a rectangular shape.

4. The soap holder of claim 1, wherein:

a. said base and said sides are comprised of stainless steel, aluminum, ceramic, glass, plastic, or porcelain.

5. The soap holder of claim 1, wherein:

a. said base and sides are of a single formed piece.

6. The soap holder of claim 1, wherein:

a. teeth are formed in said sides extending substantially perpendicular from said base.

7. The soap holder of claim 1, wherein:

a. teeth are formed in said sides extending initially perpendicular from said base then tapering outwards therefrom.

8. The soap holder of claim 6, wherein:

a. said teeth are rounded or pointed.

9. The soap holder of claim 7, wherein:

a. said teeth are rounded or pointed.

10. The soap holder of claim 1, wherein:

a. said lip has indentions therein facilitating drainage therethrough.

11. A soap holder comprising:

a. a cap structure having i. a flat rigid base having openings therein and a uniform geometric shape, and ii. sides extending substantially perpendicular from said base;

b. said sides being thin and rigid so as to be easily pressed into a bar of soap for retaining and supporting the soap thereon; and c. said base having a lip extending substantially perpendicular therefrom in the opposite direction from said sides.

12. The soap holder of claim 11, wherein:

a. said base has a circular, oval shape, square shape or rectangular shape.

13. The soap holder of claim 11, wherein:

a. teeth are formed in said sides extending substantially perpendicular from said base.

14. The soap holder of claim 13, wherein:

a. said teeth are formed in said sides extending initially perpendicular from said base then tapering outwards therefrom.

15. The soap holder of claim 11, wherein:

a. said lip has indentions therein facilitating drainage therethrough.

16. The soap holder of claim 11, wherein:

a. said uniform geometric shape is taken from the group consisting of a circular shape and a rectangular shape.

17. The soap holder of claim 11, wherein:

a. said base and said sides are comprised of stainless steel, aluminum, ceramic, glass, plastic, or porcelain.

18. The soap holder of claim 11, wherein:

a. said base and sides are of a single formed piece.

* * * * *